US010568356B2

(12) United States Patent
Karles et al.

(10) Patent No.: US 10,568,356 B2
(45) Date of Patent: Feb. 25, 2020

(54) FLAVOR CAPSULE FOR ENHANCED FLAVOR DELIVERY IN CIGARETTES

(75) Inventors: Georgios Karles, Richmond, VA (US); Martin Garthaffner, Richmond, VA (US); Richard Jupe, Richmond, VA (US); Diane Kellogg, Ashland, VA (US); Ila Skinner, Colonial Heights, VA (US); Jose Nepomuceno, Beaverdam, VA (US); John Layman, Blacksburg, VA (US); Constance Morgan, Richmond, VA (US); Jay A. Fournier, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 12/506,673

(22) Filed: Jul. 21, 2009

(65) Prior Publication Data

US 2009/0277465 A1 Nov. 12, 2009

Related U.S. Application Data

(62) Division of application No. 11/049,859, filed on Feb. 4, 2005, now Pat. No. 7,578,298.

(51) Int. Cl.
*A24D 3/06* (2006.01)
*A24D 3/16* (2006.01)

(52) U.S. Cl.
CPC ..... *A24D 3/163* (2013.01); *A24D 3/061* (2013.01)

(58) Field of Classification Search
None
See application file for complete search history.

(56) References Cited

U.S. PATENT DOCUMENTS 2,755,206 A * 7/1956 Statia, Sr. ..... A24D 3/061 131/187
2,863,461 A 12/1958 Frost, Jr.
(Continued)

FOREIGN PATENT DOCUMENTS

CH 648733 A5 4/1985
GB 1133885 A 11/1968
(Continued)

OTHER PUBLICATIONS

Cole, Ewart T., "Liquid filled and sealed hard gelatin capsules," Capsugel Division, Warner-Lambert Co., Switzerland. 1999.*
(Continued)

*Primary Examiner* — Michael J Felton
(74) *Attorney, Agent, or Firm* — Harness, Dickey & Pierce, P.L.C.

(57) ABSTRACT

Improved delivery of additive materials to cigarettes is provided through the use of one or more capsules containing additive materials, such as flavor components, in the filter section of a cigarette. The sealed capsule or capsules are subjected to an external force, such as squeezing, by a smoker prior to or during smoking of the cigarette in order to release at least a portion of the additive material from the one or more capsules and expose the additive material to mainstream smoke passing through the filter. The sealed capsules provide a barrier between the additive materials and other cigarettes components, such as sorbents or filter materials, in order to reduce additive material migration into the other cigarette components prior to desired use.

13 Claims, 6 Drawing Sheets

(56) References Cited

U.S. PATENT DOCUMENTS

| | | | | |
|---|---|---|---|---|
| 3,390,686 | A * | 7/1968 | Irby, Jr. | A24D 3/061 131/337 |
| 3,508,558 | A | 4/1970 | Seyburn | |
| 3,685,521 | A | 8/1972 | Dock | |
| 3,762,422 | A | 10/1973 | Dock | |
| 4,687,008 | A | 8/1987 | Houck, Jr. et al. | |
| 4,865,056 | A | 9/1989 | Tamaoki et al. | |
| 4,889,144 | A | 12/1989 | Tateno et al. | |
| 5,137,034 | A * | 8/1992 | Perfetti et al. | 131/194 |
| 5,322,075 | A | 6/1994 | Deevi et al. | |
| 5,499,636 | A | 3/1996 | Baggett, Jr. et al. | |
| 5,549,124 | A | 8/1996 | Dorsey | |
| 5,591,368 | A | 1/1997 | Fleischhauer et al. | |
| 5,666,976 | A | 9/1997 | Adams et al. | |
| 5,692,525 | A | 12/1997 | Counts et al. | |
| 5,692,526 | A | 12/1997 | Adams et al. | |
| 5,724,997 | A | 3/1998 | Smith et al. | |
| 5,915,387 | A | 6/1999 | Baggett, Jr. et al. | |
| 5,934,289 | A | 8/1999 | Watkins et al. | |
| 5,988,176 | A | 11/1999 | Baggett, Jr. et al. | |
| 6,026,820 | A | 2/2000 | Baggett, Jr. et al. | |
| 6,041,790 | A | 3/2000 | Smith et al. | |
| 6,053,176 | A | 4/2000 | Adams et al. | |
| 6,209,547 | B1 | 4/2001 | Koller et al. | |
| 6,595,218 | B1 | 7/2003 | Koller et al. | |
| 6,761,174 | B2 * | 7/2004 | Jupe et al. | 131/335 |
| 2002/0081330 | A1 * | 6/2002 | Young | 424/451 |
| 2003/0098033 | A1 | 5/2003 | Macadam et al. | |
| 2004/0187881 | A1 | 9/2004 | Jupe et al. | |
| 2004/0261807 | A1 * | 12/2004 | Dube et al. | 131/337 |

FOREIGN PATENT DOCUMENTS

| | | | |
|---|---|---|---|
| NL | 1017166 | C2 | 7/2002 |
| WO | WO03/009711 | A1 | 2/2003 |

OTHER PUBLICATIONS

Cole, Ewart T., "Liquid filled and sealed hard gelatin capsules," Capsugel Division, Warner-Lambert Co., Switzerland. 1999 (Year: 1999).*

Partial International Search Report dated Jul. 25, 2006 for PCT/IB2006/000732.

International Search Report and Written Opinion dated Sep. 29, 2006 for PCT/IB2006/000732.

International Preliminary Report on Patentability dated Aug. 7, 2007 for PCT/IB2006/000732.

* cited by examiner

FLAVOR CAPSULE FOR ENHANCED FLAVOR DELIVERY IN CIGARETTES

CROSS-REFERENCE TO RELATED APPLICATIONS

This application is a divisional application of U.S. application Ser. No. 11/049,859 entitled FLAVOR CAPSULE FOR ENHANCED FLAVOR DELIVERY IN CIGARETTES, filed on Feb. 4, 2005, the entire content of which is hereby incorporated by reference.

BACKGROUND

Sorbents incorporated in some traditional cigarettes have not satisfactorily provided the desired taste effect to the smoker. Due to volatility of added flavorants, the uniformity of flavored cigarettes has not been totally satisfactory. Thus, there is interest in improved articles and methods of delivering additive materials or agents such as flavorings to cigarettes. Irreversible loss of volatile flavors may also occur following flavor migration to sorbents used in cigarette filters to remove one or more gas phase constituents. These sorbents also adsorb flavors delivered in mainstream smoke thus reducing the taste and sensorial character/acceptability of cigarettes.

SUMMARY

In a first embodiment, a cigarette comprises a tobacco rod attached to a filter, the filter comprising filter material, sorbent material and a two-part capsule containing an additive material for modifying characteristics of tobacco smoke during smoking of the cigarette, the capsule comprising: a first part having an open end defining a first chamber containing the additive material; and a second part having an open end defining a second chamber, wherein the second part fits within the first part with the open ends facing the same direction, and wherein the capsule releases at least a portion of the additive material when the filter is subjected to external force. The force may be exerted in any direction but preferably in a direction perpendicular to the cigarette axis (which may or may not coincide with the axis of the capsule in case of long capsules).

In a second embodiment, a filter for a cigarette comprises filter material, sorbent material and a two-part capsule containing an additive material for modifying characteristics of tobacco smoke during smoking of the cigarette, the capsule comprising: a first part having an open end defining a first chamber containing the additive material; and a second part having an open end defining a second chamber, wherein the second part fits around the first part and the open ends face each other in opposite directions.

In a third embodiment, a method for delivering flavor to mainstream smoke of a cigarette which includes a filter comprising filter material, sorbent material and a two-part capsule, the capsule comprising a first part having an open end defining a first chamber containing a flavor material and a second part having an open end defining a second chamber, wherein the second part fits within the first part with the open ends facing the same direction, wherein the method comprises: subjecting the capsule to external force to release at least a portion of the flavor material from the first chamber into mainstream smoke. In the method, the cigarette is smoked and the filter is subjected to an external force to break the seal between the first part and the second part so as to release the flavor material from the capsule and deliver flavor to mainstream tobacco smoke passing through the filter.

In a fourth embodiment, a method of forming a cigarette comprises: forming at least one flavor capsule, wherein the forming comprises: mixing a menthol flavor with a shell wall solution; extruding the mixture drop-wise into a cationic solution; and harvesting and drying the capsules; incorporating the at least one flavor capsule into a filter of the cigarette, wherein the at least one flavor capsule has a distinct core and a distinct shell geometry and the menthol flavor is non-uniformly dispersed in the at least one flavor capsule; and incorporating a sorbent into the filter of the cigarette upstream from the at least one capsule.

DETAILED DESCRIPTION

Figure 1:
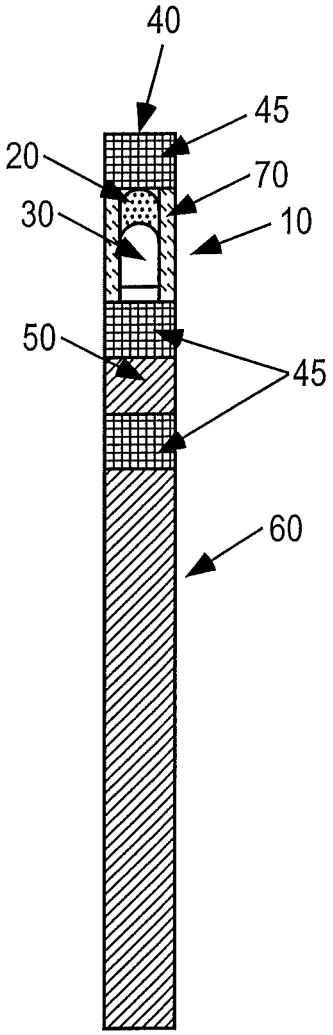
FIG. 1 is a cross-sectional view of a cigarette constructed in accordance with an embodiment.

A filter arrangement with an additive material, such as a flavor component, in a tobacco product, such as a cigarette, is provided. Improved delivery through controlled release of the additive material to cigarettes may be achieved through the use of one or more capsules, which are preferably sealed or frangible capsules, containing the additive material. This use of capsules allows for the core of the capsule to be controllably released by the smoker. This controlled release provided by the capsules can reduce reactivity between the additive material and the cigarette, decrease evaporation and migration of the additive material within the cigarette, allow for uniform or non-uniform distribution of the additive material, control the release of the additive material to achieve the proper timing until a predetermined stimulus and/or allow for in situ mixing of additive materials.

The one or more capsules are preferably contained in the filter section of the cigarette, whereby the use of external force causes the one or more capsules to be mechanically opened prior to or during use of the cigarette. The opening of the one or more capsules allows the additive material to escape from the capsule(s) and interact with and modify the characteristics of the cigarette and thus the smoke derived therefrom. For example, the additive material may be used to provide one or more volatile flavor components to tobacco smoke passing through the filter or it may be used to provide a selective filtration compound (i.e., amine, etc.) which may have enhanced reactivity if presented in a wet state while it may require protection from drying and/or premature reaction with atmospheric components or light during storage.

A. Cigarettes

A cigarette typically contains two sections, a tobacco-containing portion sometimes referred to as the tobacco or cigarette rod, and a filter portion which may be referred to as a filter tipping. Tipping paper typically surrounds the filter, which forms the mouth end of the cigarette. The tipping paper overlaps with the tobacco rod in order to hold the filter and tobacco rod together. The tobacco rod, or tobacco containing element of the cigarette, includes the paper wrapper in which the tobacco is wrapped and the adhesive holding the seams of the paper wrapper together. The tobacco rod has a first end which is integrally attached to the filter and a second end which is lit or heated for smoking the tobacco. When the tobacco rod is lit or heated for smoking, the smoke travels from the lit end downstream to the filter end of the tobacco rod and further downstream through the filter.

The filter can be used with traditional cigarettes and non-traditional cigarettes. Non-traditional cigarettes include, for example, cigarettes for electrical smoking systems as described in commonly-assigned U.S. Pat. Nos. 6,026,820; 5,988,176; 5,915,387; 5,692,526; 5,692,525; 5,666,976; and 5,499,636, the disclosures of which are incorporated by reference herein in their entireties.

An exemplary embodiment of a method of making cigarettes comprises providing a cut filler to a cigarette-making machine to form a tobacco portion (e.g., a tobacco column); placing a paper wrapper around the tobacco column to form a tobacco rod; and attaching a filter portion to the tobacco rod to form the cigarette.

The term "mainstream smoke" includes the mixture of gases and/or aerosols passing down a cigarette, such as a tobacco rod, and issuing from an end, such as through the filter end, i.e., the amount of smoke issuing or drawn from the mouth end of a cigarette during smoking of the cigarette. The mainstream smoke contains air that is drawn in through the heated region of the cigarette and through the paper wrapper.

"Smoking" of a cigarette is intended to mean the heating, combusting or otherwise causing a release of certain chemicals from tobacco. Generally, smoking of a cigarette involves lighting one end of the cigarette and drawing the smoke downstream through the mouth end of the cigarette, while the tobacco contained therein undergoes combustion, pyrolysis or distillation of volatiles. However, the cigarette may also be smoked by other means. For example, the cigarette may be smoked by heating the cigarette using an electrical heater, as described, for example, in commonly-assigned U.S. Pat. Nos. 6,053,176; 5,934,289; 5,591,368 or 5,322,075, each of which is incorporated herein by reference in its entirety.

B. Tobacco

Examples of suitable types of tobacco materials that may be used include, but are not limited to, flue-cured tobacco, Burley tobacco, Maryland tobacco, Oriental tobacco, rare tobacco, specialty tobacco, blends thereof and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. Tobacco substitutes may also be used.

In traditional cigarette manufacture, the tobacco is normally used in the form of cut filler, i.e., in the form of shreds or strands cut into widths ranging from about 1/10 inch to about 1/20 inch or even about 1/40 inch. The lengths of the strands range from between about 0.25 inch to about 3.0 inches. The cigarettes may further comprise one or more flavors, or other suitable additives (e.g., burn additives, combustion modifying agents, coloring agents, binders, etc.).

C. Filters

The filter material of the filter may be any of the variety of fibrous materials suitable for use in tobacco smoke filter elements. Typical fibrous materials include cellulose acetate, polypropylene or paper. Preferably, the filter material will be cellulose acetate.

The filter of a cigarette also includes a sorbent such as sorbent particles. Preferably, the sorbent particles have a size of about 0.3 mm to about 0.85 mm or 20 to 50 mesh size to facilitate loading into cavities of cigarette filters so as to achieve a desirable filter pressure drop (resistance to draw). This applies to a situation where the sorbent fills a well defined cavity in the filter section. Sorbents can be used in other forms in cigarette filters, e.g., sorbent articles may be distributed in the filamentary tow and in that form may be used as different segment lengths in the filter to provide the desirable reduction in one or more mainstream gas phase constituents.

Various cigarette filter constructions may be used, in which one or more capsules may be incorporated. Exemplary filter structures that may be used include, but are not limited to, a mono filter, a dual filter, a triple filter, a single or multi cavity filter, a recessed filter, a free-flow filter, combinations thereof and the like. Mono filters typically contain cellulose acetate tow or cellulose paper materials. Pure mono cellulose filters or paper filters offer good tar and nicotine retention, and are highly degradable. Dual filters typically comprise a cellulose acetate mouth end and a pure cellulose or cellulose acetate segment. The length and pressure drop of the segments in a dual filter may be adjusted to provide optimal sorption, while maintaining acceptable draw resistance. Triple filters may include mouth side and smoking material or tobacco side segments, and a middle segment comprising paper. Cavity filters include at least two segments, e.g., acetate-acetate, acetate-paper or paper-paper, separated by at least one cavity. Recessed filters include an open cavity on the mouth side. The filters may also be ventilated and/or comprise additional sorbents, catalysts or other additives suitable for use in the cigarette filter.

A filter region of an exemplary embodiment of a cigarette may be constructed with an upstream sorbent and a downstream capsule. A sorbent, for example, activated carbon, can be located in a cavity at a distance from one or more capsules, which can be located in a second section or portion of a filter spaced from the sorbent. Such arrangement would allow for the filtration of the cigarette to be accomplished by the sorbent, and for the flavor to be disposed within the cigarette without the effectiveness of the flavor being affected by absorption or adsorption by the sorbent.

D. Sorbents

As used herein, the term "sorption" denotes filtration by adsorption and/or absorption. Sorption is intended to encompass interactions on the outer surface of the sorbent, as well as interactions within the pores and channels of the sorbent. In other words, a "sorbent" is a substance that may condense or hold molecules of other substances on its surface, and/or take up other substances, i.e., through penetration of the other substances into its inner structure, or into its pores.

As used herein, the term "sorbent" refers to either an adsorbent, an absorbent, or a substance that may perform both of these functions.

As used herein, the term "remove" refers to adsorption and/or absorption of at least some portion of a constituent of mainstream tobacco smoke.

While any suitable material may be used as a sorbent, preferred embodiments include activated carbon sorbents or microporous materials. The sorbent may be any material which has the ability to absorb and/or adsorb gas constituents on the surface thereof or to assimilate such constituents into the body thereof. If desired, the sorbent can incorporate catalyst material therein. By way of example, sorbent materials may include, but are not limited to, carbons such as activated carbon, aluminas, silicates, molecular sieves, and zeolites and may be used alone or in combination. In a preferred embodiment, the sorbent material is activated carbon.

Microporous materials (i.e., microporous sorbents) such as, for example, an activated carbon can be used to filter out gas constituents from cigarette smoke. The microporous sorbent may have pores with widths or diameters of less than about 20 Å.

While microporous materials are useful for filtering cigarette smoke, microporous materials may also hinder a cigarette designer's ability to add volatile flavor components like menthol, for example. In particular, microporous sorbents tend to adsorb and/or absorb the flavor components during the time between cigarette manufacture and use by the consumer, thus reducing the effectiveness of the flavor components in the cigarette.

In addition to the reduction of the effectiveness of the flavor components due to the adsorption/absorption by the microporous sorbents, two additional problems are also encountered when the flavor component migrates to and is adsorbed/absorbed by the sorbent. First, the flavor component may occupy active sites in the sorbent; thereby reducing the sorbent's ability to remove gas phase constituents from smoke. Second, because the flavor component is often strongly adsorbed/absorbed by the sorbent, the flavor component may not be sufficiently releasable. As such, separation between the microporous materials and the flavor components, or other additives is desired.

Another advantage of the controlled release of encapsulated volatile flavors in the filter is that encapsulated volatile additives are added to the smoke stream through the filter portion. By adding the additives to the filter, potential pyrolytic reactions that can lead to change in their character and sensorial impact are circumvented.

E. Additives

The term "additive" means any material or component which modifies the characteristics of a cigarette when the cigarette is smoked. Any appropriate additive material or combination of materials may be contained inside the one or more capsules to modify the characteristics of the cigarette. Such additive materials include flavors, neutralizing agents, and other smoke modifiers, such as chemical reagents like 3-aminopropylsilyl (APS) which interacts with smoke constituents. Additionally, the additive materials may also include diluents, solvents or processing aids that may or may not impact the sensorial attributes of the mainstream smoke but aid in processing of an additive and its encapsulation and presentation in a cigarette.

In a preferred embodiment, the additive materials may include one or more flavors, such as liquid or solid flavors and flavor formulations or flavor-containing materials. The term "flavor" or "tobacco flavor" may include any flavor compound or tobacco extract suitable for being releasably disposed in liquid form within two-part capsules macrocapsules or microcapsules to enhance the taste of mainstream smoke produced, for example, by a cigarette.

Suitable flavors or flavorings include, but are not limited to, menthol, mint, such as peppermint and spearmint, chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, ginger oil, and tobacco flavor. Other suitable flavors may include flavor compounds selected from the group consisting of an acid, an alcohol, an ester, an aldehyde, a ketone, a pyrazine, combinations or blends thereof and the like. Suitable flavor compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

In one embodiment, the additive material may serve as a chemical reagent for one or more constituents of mainstream smoke. Such an additive material may include, by way of example, a chemical additive which interacts with the one or more constituents in mainstream smoke. For example, see commonly assigned U.S. Pat. Nos. 6,209,547 and 6,595,218, which discuss reagents which can interact with and can remove gaseous constituents of a smoke stream, and are expressly incorporated herein by reference in their entireties.

F. Capsules

The capsules in the filter arrangement provide advantages particularly for cigarettes containing activated carbon. By placing the sealed capsules in the filter downstream from activated carbon in cigarettes containing activated carbon in the filter, adsorption of released additive material by the activated carbon and consequent deactivation of the carbon is substantially prevented. Thus, where the additive material is a flavor component, flavor adsorption by the activated carbon during storage of cigarettes and during smoking is substantially prevented.

By incorporating the additive material in one or more capsules, in a filter, loss of flavor to side stream smoke is substantially reduced and less or none of the flavor component is pyrolyzed during the smoking of the cigarette. In addition, by positioning the one or more capsules containing the additive material in the filter section, the activated carbon can maintain its ability to modify cigarette smoke, which includes removing volatile organic components, such as 1,3-butadiene, acrolein, isoprene, etc., from mainstream smoke.

The term "releasably disposed" as used herein to refer to the containment and release of additive materials in capsules such that the additive materials are sufficiently contained to substantially avoid or minimize unwanted migration, such as, for example, during storage. This term also includes, but is not limited to, the additive materials in the capsule being mobile enough to be released from the capsule when, for example, the capsule is broken or opened by mechanical force. For example, the capsule may be broken by squeezing a portion of a cigarette filter containing the capsule, thus releasing the additive material from within the capsule.

The capsule may be formed in a variety of physical formations including singular part or multipart capsules, large capsules, small capsules, microcapsules, etc. One preferred formation is a two-part capsule, while another preferred embodiment includes macrocapsules or microcapsules. While either of these preferred embodiments may include liquid additives, the additives may be released similarly in the preferred embodiments by mechanical action. The capsules may be present in the filter section of a cigarette in a dispersed arrangement if small macrocapsules or microcapsules are provided, or may be present in a plug or cavity within a filter for one more capsules, preferably two-part capsules or microcapsules. However, the capsule or capsules are preferably present downstream from any sorbents in a cigarette, such as activated carbon.

The microcapsules may be formed by any suitable technique including encapsulation techniques, such as spin coating, coacervation, interfacial polymerization, solvent evaporation, annular jet forming, which uses two concentric jets to eject an inner jet of liquid core material and an outer jet of liquid wall material where the fluid stream breaks into droplets and the liquid wall material solidifies by phase transition induced by the presence of cross-linking ions, pH differences, temperature changes, etc.

Single wall or multi-wall capsules may be used to tailor capsule stability, strength, rupture resistance, processing ease in filter making, etc. The capsules may be made of any suitable material, such as those used in capsules for drug delivery, liquid encapsulated capsules, or other encapsulated materials. By way of example, capsules typically utilized in the pharmaceutical industry may be used. Such capsules may be gelatin based, for example, or may be formed from a polymeric material, such as modified cellulose. One type of modified cellulose which may be used is hydroxypropylmethyl cellulose.

G. Preferred Embodiments

A preferred embodiment of a capsule that can be used to contain an additive material is a two-part capsule, which preferably includes a primary reservoir for additive material, where the additive material may be present in any form suitable for release from the capsule. By way of example, the primary reservoir may be completely or partially filled with a fluid additive or additives and/or may contain: a porous compressive material such as a sponge saturated with additive(s), or non-adsorbing solids to decrease the space available for the additive(s) or even additive-containing microcapsules to protect them from possible premature rupture during the rigor of filter making. Preferably, walls of the one or more capsules protect the additive material from migration and allow for controlled release of the additive material.

Figure 2:
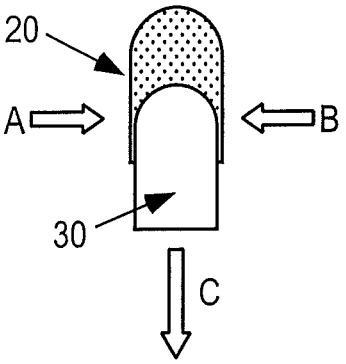
FIG. 2 is an illustration of a sealed capsule for use in a filter of a cigarette according to an embodiment.
Figure 3:
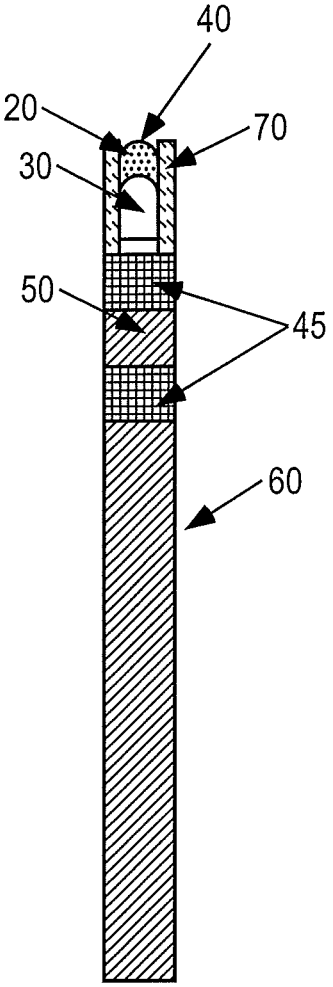
FIG. 3 is a cross-sectional view of a cigarette constructed in accordance with an embodiment.

In a preferred two-part capsule, the two parts seal and/or lock the additive material within a primary reservoir and prevent leakage of the additive material prior to intended release by mechanical action. In a preferred embodiment, the capsule includes two parts which lock or fit sealingly into place and then at least partially separate by application of an external force allowing for release of liquid or vapor from a contained additive material from within the two-part capsule, as illustrated in FIGS. 1-3. The seal formed by the two parts can be a mechanical seal. However, to improve seal quality a banded seal is provided externally to the capsules at the point where the two capsule parts come together. The bands may be made out of gelatin, HPMC or other suitable materials, preferably a material similar to the material used to form the capsules.

In order to release the contained additive material from the two-part capsules, preferably an external force, such as a mechanical action, is applied. One preferable method of applying the external force would be to have a user squeeze or exert an external force on a filter containing the two-part capsule prior to or during the smoking of the cigarette. The squeezing action or application of external force preferably would at least partially deform the primary reservoir, which in turn would cause a displacement of mechanically locked or sealed in place internal components of the capsule. This displacement would then create one or more open spaces between internal components through which at least a portion of the additive material may be released from the capsule, e.g., liquid and/or vapor can be released from the capsule to modify the tobacco smoke passing through the filter. The acting force can be in a direction along or across the cigarette axis. Torsion may also be applied. An external device, such as a pinching device, a tube squeezing device, tweezers or any other device for applying torsion or compression forces, may also be used to concentrate the force at a prescribed filter location repeatedly.

Preferably, the two parts of the capsule physically separate rather than rupture upon being squeezed by the user, in order to provide for a more predictable result. However, rupture may also be used as rupturing the capsule would also result in creating open spaces through which at least a portion of the additive material may be released from the capsule.

As an alternative to the two-part capsule, flavor solutions encapsulated within a singular-part, seamless capsule can be provided for a similar purpose. In an exemplary embodiment, microcapsules may be provided in a cigarette filter, where the microcapsules include additive materials therein. Similarly, macrocapsules and microcapsules may be ruptured by applying force, wherein the macrocapsules and microcapsules are ruptured to release additive materials therein.

The macrocapsules or microcapsules may be distributed uniformly or non-uniformly within the entirety of the cigarette filter, within a discrete portion of the cigarette filter, or within more than one portion of the cigarette filter. Alternatively, in another exemplary embodiment, microcapsules may be included within a cellulose acetate filter segment separate from an adsorbent region within the cigarette filter. It is noted that the terms "capsules" or "macrocapsules" are intended to define large capsules, preferably equal to or larger than about 1 mm in diameter, while the term "microcapsules" are defined as smaller capsules, preferably smaller than 1 mm.

A preferred cigarette would include a tobacco rod integrally attached to a filter, where the filter would include a filter material, a sorbent material and at least one capsule containing an additive material for modifying the characteristics of the cigarette smoke.

Alternatively, another preferred cigarette would include a tobacco rod integrally attached to a filter, where the filter includes discrete, adjacent sections, wherein a first section comprises a filter material, a second section comprises a sorbent material and a third section includes one or more capsules containing an additive material for modifying characteristics of tobacco smoke during smoking of the cigarette, wherein the capsule comprises: a frangible wall or sealed wall encapsulating the additive material, wherein the frangible wall or seal breaks to expose the additive material to tobacco smoke passing through the filter when the filter is subjected to external force.

Preferably, a cigarette filter is arranged with the one or more capsules placed downstream from a sorbent material with filter material between the one or more capsules and the sorbent material or at the mouth end of the filter with one or more capsules placed between the mouth end of the filter or between the filter and the mouth end of the filter.

A capsule according to a preferred embodiment can be incorporated into the filter portion of a cigarette by way of a hollow tube, wherein the capsule partially fills the diameter of the tube allowing for smoke to flow through the tube and around the capsule. The hollow tube may be made of any material compatible with filter materials which may contain the capsule but not prevent the capsule or microcapsules from releasing an additive upon external force being applied to the filter. In a preferred embodiment, the hollow tube is a hollow acetate tube.

In one embodiment, the capsule is made of two parts, a first part and a second part, as mentioned above, where the first part has an open end, and the second part also has an open end. Thus, each part is hollow with an open end. The first part contains an additive formulation in liquid, solid or absorbed form and provides the primary reservoir for the additive. The second part can be inserted into the first part, creating a tight seal between the two hollow parts. The tight seal, such as a mechanical seal, can be enhanced via the use of a band seal at the junction of the two capsule parts to prevent or minimize migration or leakage of the additive material. The capsule can then be inserted into a filter portion of a cigarette. In one embodiment, the capsule is inserted into a hollow acetate tube and then incorporated into a cigarette filter, as shown, by way of example, in FIG. 1. By squeezing the filter containing the capsule, the additive is released. The additive used may be selected to be absorbed in the hollow acetate filter to provide consistent puff delivery.

In another embodiment, the two-part capsule provides for the additive to be pumped out through the open spaces created upon the mechanical opening of the capsule. In this embodiment, when the two-part capsule is squeezed, the seal between the two parts is opened and liquid additive is pushed over the top of the part of the capsule which serves as the primary reservoir (directionality is offered for clarity). Liquid additive then flows to the exterior of the capsule and this additive may then be transferred to mainstream smoke during smoking of the cigarette.

In another embodiment, the two-part capsule is designed to maintain the separation of the two parts of the capsule so the additive may continue to be released into the filter, thus making the additive continuously available to mainstream smoke during smoking of the cigarette. By way of example, the mechanical opening created between the two parts of the capsule may be kept open by use of particles dispersed in the additive which flow out of the capsule and interfere with the closing of the two parts of the capsule as the particles flow and get trapped between the first and second parts of the capsule.

Also, a double capsule can be used herein. Preferably, a double capsule may be formed by a smaller capsule inside a larger one. These two capsules may contain materials or formulations that may or may not be compatible with each other. Double capsules, such as the DuoCap™ by Encap Drug Delivery of W. Lothian, Scotland can be used to hold the additive(s).

Cigarettes, filters and flavor capsules, which include two parts, in accordance with a first preferred embodiment are further illustrated in FIGS. 1-6. FIG. 1 illustrates a cigarette which comprises a tobacco rod 60 integrally attached to filter 40. Filter 40 includes first filter material regions 45, a sorbent region 50 and a hollow acetate tube 70 containing a two-part capsule 10 having a first part 20 and a second part 30 inserted therein. The first part 20 is open at one end and functions as the primary reservoir for the additive material. The closed hemispherical end of the second part 30 is sealingly disposed in the open end of the first part 20. The sorbent is preferably activated carbon. The capsule of FIG. 1 may be opened by a user of the cigarette squeezing the filter in the area of hollow acetate tube 70, causing deformation of the capsule 10 with at least partial mechanical separation of the first part 20 and the second part 30, thus releasing the additive from the primary reservoir in first part 20, i.e., the additive is exposed to mainstream smoke passing through the filter.

As shown in more detail in FIG. 2, first part 20 and second part 30 are shown in a similar orientation as FIG. 1, wherein the first part 20 would be oriented toward the buccal end of the cigarette while the second part 30 would be oriented toward the tobacco rod 60. As shown, the first and second parts 20, 30 can be made to mechanically separate when forces are applied as shown by arrows A and B (around the circumference of the cigarette on the hollow acetate tube 70). The second part 30 is forced in the direction of C (toward the tobacco rod) when forces A and B are applied and therefore the second part 30 is partially or completely forced out of a sealing relationship with the first part 20, releasing the additive in the primary reservoir in the first part 20.

FIG. 3 illustrates a second preferred embodiment of a flavor capsule similar to the first preferred embodiment but without the first filter material region 45 at the mouth end. In this embodiment, the last section of the filter 40 is removed and a hollow acetate tube 70 containing a capsule 10 with first part 20 and second part 30 is at the mouth end so that the additive can be directly provided to mainstream smoke as it is drawn out of the filter. By removing the first filter material region 45 from the mouth end, an end user can squeeze the capsule therein to release a liquid flavor and wet segment 45, and then the capsule 10 can be removed and disposed of prior to smoking. Preferably, if removal of the capsule after use is desired, the capsule can be incorporated so as to at least partially protrude from the mouth end of the cigarette, such that the protrusion can be gripped with fingers for easier removal.

Figure 4A:
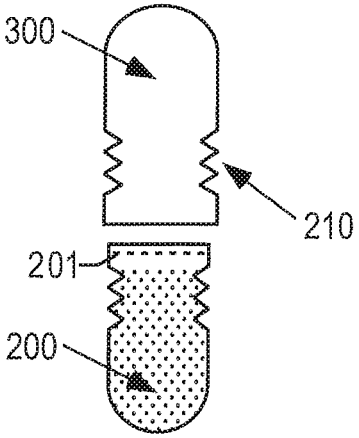
FIG. 4*a* is an exploded illustration of a capsule for use in a filter of a cigarette according to an embodiment.

A third preferred embodiment of a flavor capsule is illustrated in FIGS. 4*a-d*. As shown, in FIG. 4*a*, a two-part capsule may be formed with a first part 200 (with additive therein) and a second part 300 where the two parts can be sealingly attached to each other with annular indentations 210. The first part 200 and the second part 300 after being sealingly attached to one another can then be used as a pump to release the additive material, where the first part 200 serves as the primary reservoir for the additive material and the second part 300 aids in delivery of the additive material. The annular indentations 210 may be provided on both the first part 200 and second part 300 for providing a locked and sealed structure and may be any form providing a seal which allows for release of the additive under application of an external force. Additionally, portions of the capsule can be scored (see e.g. scored portion 201 as shown in FIG. 4*a*) to reduce the amount of force required to rupture the capsule.

Figure 4B:
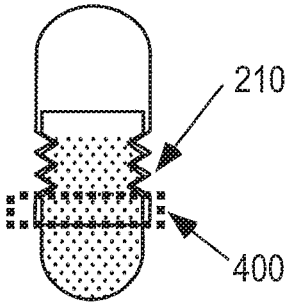
FIG. 4*b* is an illustration of a sealed capsule for use in a filter of a cigarette according to an embodiment.

As shown in FIG. 4*b*, the open end of the second part 300 can fit over the open end of first part 200 with indentations 210 serving to keep the capsule sealingly closed until the capsule is squeezed. Additionally, a seal band 400 can also be provided around a joint between the first and second parts, a portion of the second part alone or a portion of the first part and the second part to further seal the capsule. Preferably, the seal band 400 is an impervious and impermeable material which creates an impervious and impermeable seal for the capsule.

Figure 4C:
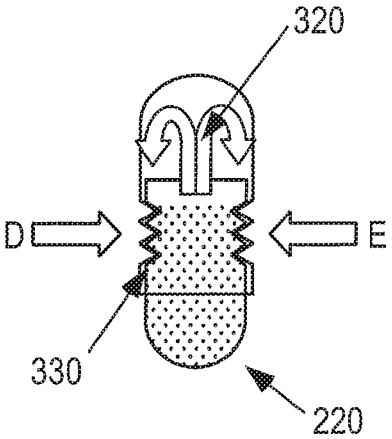
FIG. 4*c* is an illustration of the operation of a capsule for use in a filter of a cigarette according to an embodiment.

FIG. 4*c* illustrates the pump action of the capsule whereby external force is applied at D and E, pushing the additive through the opening 330 created between the first part and the second part of the capsule. The two parts, 200 and 300, are mechanically separated through the forces applied at D and E by squeezing the capsule, providing an opening 330 between the two parts. The additive material, which is preferably liquid, may thus wet areas outside of the capsule, such as portions of the filter like a cellulose acetate region, as the additive is forced up and out (indicated by arrow 320) of the capsule through the opening 330 between the first part 200 and the second part 300.

Additionally, indentations may be introduced during the making of the capsule parts. These indentations may be used to concentrate forces applied to the capsule onto weaker portions or points of the capsule leading to an easier rupture of the capsule.

When the capsule is squeezed as shown in FIG. 4*c*, the sealed or locked formation between the first part 200 and the second part 300 is opened allowing the additive to escape from the capsule and thus mix with tobacco smoke passing through the filter if the capsule is used in a cigarette. Additionally, it is noted that the capsule may break at weak points of the capsule. For example, regions around the corners 220 of the capsule tend to be weaker and may be subject to breaking.

Figure 4D:
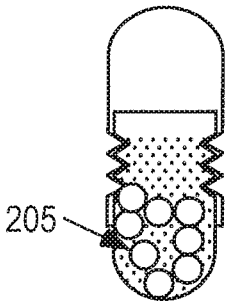
FIG. 4*d* is an illustration of a sealed capsule for use in a filter of a cigarette according to an embodiment wherein solids are present in the sealed capsule.

In a further embodiment, as shown in FIG. 4*d*, solids 205 such as sponges or particles of silica, alumina, carbon or other material may be located in the first part 200 to absorb the additive or act as fillers (i.e., to take up space in the first part 200) to allow for the use of smaller amounts of additive in the capsule. Alternatively, the solids 205 may be flavor compound particles or flavor containing particles such as flavored carbon or other porous material such as molecular sieve material, wherein the liquid may be omitted or may be adsorbed in pores of the particles.

Figure 5A:
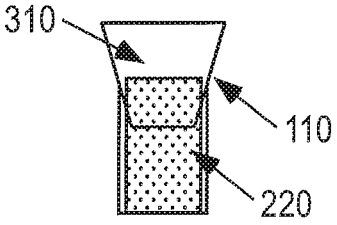
FIG. 5*a* is an illustration of a sealed capsule for use in a filter of a cigarette according to an embodiment.
Figure 5B:
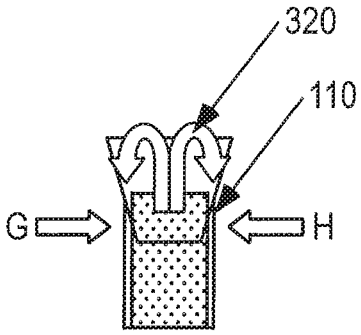
FIG. 5*b* is an illustration of the operation of a capsule for use in a filter of a cigarette according to an embodiment.

FIGS. 5*a-b* illustrate another embodiment of a flavor capsule. In FIG. 5*a*, a first part 220 comprises a primary reservoir for a flavor component and a second part 310 is locked into place in the cavity of first part 220. Upon squeezing or applying force on the capsule at points G and H as shown in FIG. 5*b*, the first part 220 and second part 310 mechanically separate enough to form a gap or opening at portion 110 through which the flavor component may be released and may contact with tobacco smoke passing through the filter of the cigarette and mix or become entrained with the tobacco smoke.

Figure 6A:
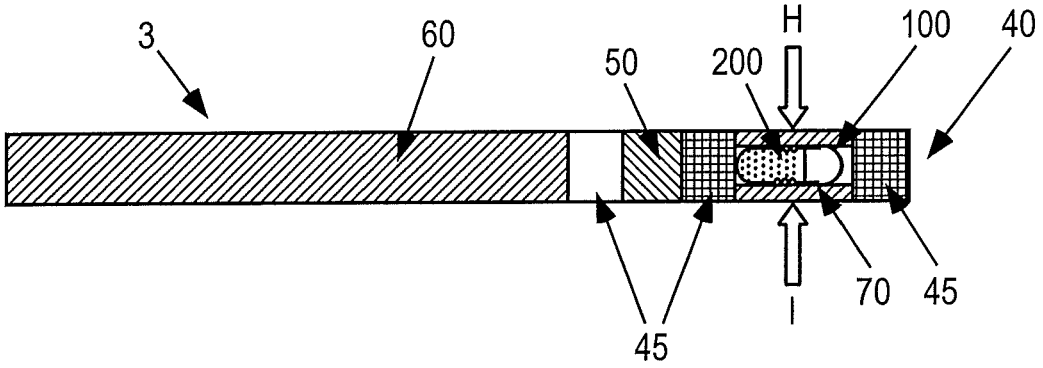
FIG. 6*a* is a cross-sectional view of a cigarette constructed in accordance with an embodiment including a capsule in the filter of the cigarette.
Figure 6B:
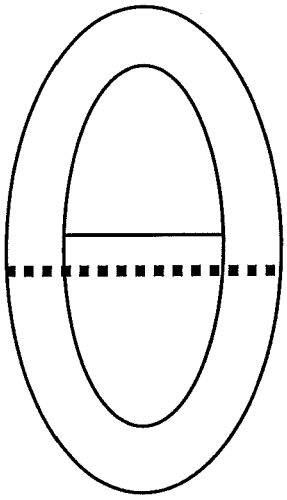
FIG. 6*b* is an illustration of a double capsule containing additives.

An exemplary embodiment of the flavor capsule of FIGS. 4*a-d* in a cigarette is shown in FIG. 6*a*, wherein a two-part capsule 100 for the additive material is located in a filter 40 downstream from a sorbent region 50 in cigarette 3. The filter 40 may be attached to tobacco rod 60 where the filter 40 has a filter material region 45 adjacent the tobacco rod 60, a sorbent region 50, filter material regions 45, wherein the two-part capsule 100 may be located between the filter material regions 45. The two-part capsule 100 can be frictionally fitted in a hollow acetate tube 70. Additionally, a double capsule, as illustrated in FIG. 6*b*, can be incorporated in cigarette 3, wherein the double capsule can include additives or active formulations.

Upon use, a portion of the filter area of cigarette 3 may be squeezed with forces H, I on either side of the capsule 100, causing at least partial mechanical separation of the first part 200, which includes a primary reservoir for the additive component, from the second part 300 as illustrated in FIG. 4*c*. As in FIGS. 4*a-d*, when the capsule 100 in the cigarette 3 of FIG. 6 is squeezed prior to use, the additive component flows through an opening created between the first part 200 and the second part 300 of the capsule 100 and can wet or apply additive outside of the capsule 100. Preferably, the capsule provided has a burst strength of about 0.5-0.8, 0.8-1.2, 1.2-1.6, 1.6-2.0 or 2.0-2.4 kilograms force (kgf). As the cigarette 3 is smoked, the additive can then be exposed to mainstream smoke passing through the filter.

Figure 7A:
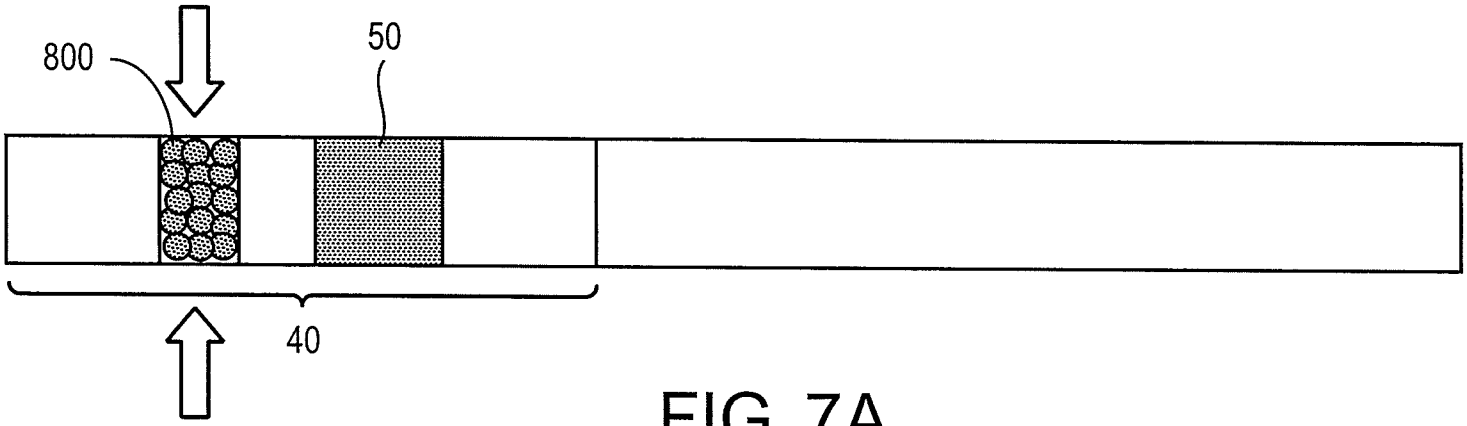
FIG. 7*a* is a cross-sectional view of a cigarette constructed in accordance with an embodiment including microcapsules in a filter of the cigarette.

In another embodiment, the capsule can be in the form of one or more microcapsules which encapsulate additive(s). Each microcapsule may be used alone or in combination with other microcapsules 800, as illustrated in FIG. 7*a*. When used in a cigarette, each microcapsule can contain the same or different additives from other microcapsule(s) in the cigarette (if present) depending upon the additive(s) desired. For example, as illustrated in FIG. 7*a*, a combination of ten menthol flavored microcapsules and five tobacco flavored microcapsules can be incorporated into a cigarette filter to provide a preferred menthol-tobacco combination of flavors.

Figure 7B:
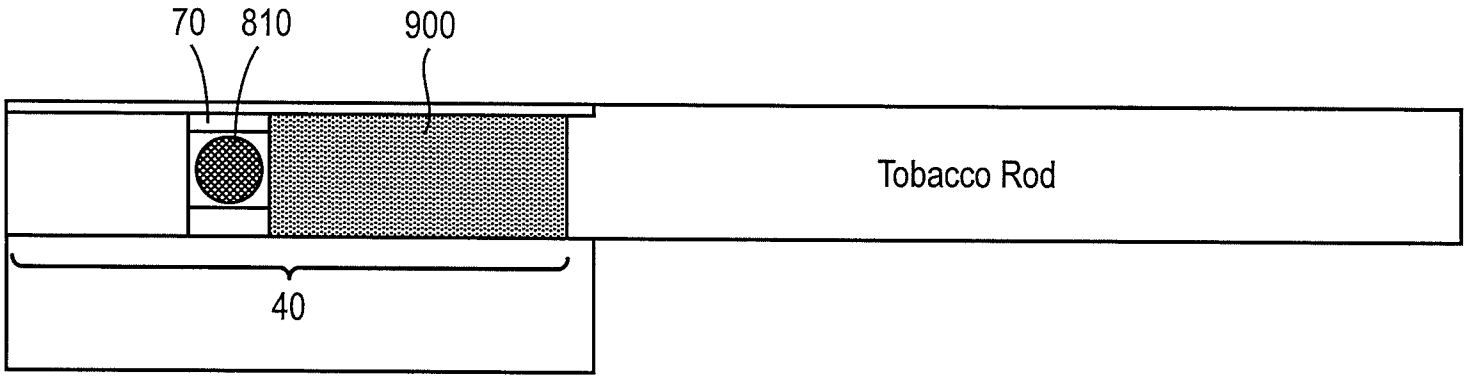
FIG. 7*b* is a cross-sectional view of a cigarette constructed in accordance with an embodiment including a macrocapsule in a filter of the cigarette and sorbents in a filter material.

As another example, one or more larger macrocapsules, as illustrated in FIG. 7*b*, which can be a sphere, such as a flavor sphere or spherical flavor capsule, can be provided.

Release of the additives from the microcapsules can be achieved by squeezing with force on either side of the cigarette filter 40 containing the microcapsules 800 or macrocapsules 810, as illustrated in FIGS. 7*a-b*. By providing the force, one or more of the microcapsules 800 or macrocapsules 810 may be ruptured and the additive(s) within the microcapsules 800 or macrocapsules 810 may be released into the cigarette. Thus, the additive(s) are released within the cigarette filter at a point downstream from sorbent 50 only after force is applied, allowing the additive(s) to be delivered within a cigarette while also reducing interaction between the additive(s) and the sorbent.

The capsules, preferably either a two-part capsule or one or more microcapsules or macrocapsules, of the preferred embodiments provide a number of advantages for supplying an additive component to a cigarette. Migration of the additive is minimized due to the use of a capsule which retains the additive in a primary reservoir or within the microcapsules until use. The additive release may be achieved by squeezing the filter containing the capsules on each cigarette individually, while leaving the remaining cigarettes in the pack. These remaining cigarettes maintain their sealed additives in the filters until the capsules in their filters are ruptured, releasing the additive. The capsules provide a protective structure to prevent or minimize the migration of the additive component during storage and the sorption of the additive component by sorbent material in the filters and/or other parts of the cigarettes. The downstream location of the capsule allows delivery of flavor compounds to the smoker without interfering substantially with any upstream sorbent such as activated carbon. The location of the capsules in the filter also minimizes loss of flavor to side stream smoke.

The additive which is released from the capsules upon squeezing or applying external force to the capsules in the filters may be supplied in any amount desirable for the particular type of additive used. The amount may be determined by the specific design of the capsules, particularly the first part of a two-part capsule which serves as the primary reservoir for the additive component or the number and size of the microcapsules present in the filter. Typically, the amount of additive used per cigarette may be extremely small since the additive is substantially sealed in the capsules during packaging and storing of the cigarette. By way of example, when a flavor is used as the additive, a few drops, e.g., 3-6, 6-9, 9-12 microliters, of flavoring may be sufficient in microcapsules, or more drops, e.g., 6-9, 9-12, or 12-15 or more microliters, may be sufficient in a two-part capsule or a macrocapsule to provide an appropriate amount of flavor to the mainstream smoke when the cigarette is smoked.

The viscosity of the additive may also be controlled to allow for controlled wicking of the additive into a cellulose acetate portion of a filter next to one or more capsules. It is believed that a slower wicking facilitated by a higher viscosity liquid could potentially reduce additive staining on a filter paper of a cigarette. Viscosity modifiers that could be used can include beeswax or other waxes for hydrophobic formulations and modified cellulosics, etc. for hydrophilic formulations.

The capsules may be of any size suitable for use in a cigarette. In order to provide a two-part capsule in a filter for a cigarette, the two-part capsules are preferably less than the diameter of the cigarette, e.g., less than 2 mm, 2 to 3 mm, 3 to 4 mm, 4 to 5 mm or greater than 5 mm, and can vary in length depending on the length of the filter, e.g., less than 8 mm, 8-10 mm, 10-12 mm, or more than 12 mm. For traditional cigarettes a two-part capsule is preferably about 2 to 4 mm in diameter and about 8-11 mm in length as this allows for a desired amount of liquid additive component to be held within the two-part capsule while the two-part capsule also fits into the filter and provides a conveniently large target for the end user to apply force.

The two-part capsule is preferably placed in a hollow tube, by way of example, a hollow acetate tube, having an external diameter similar to that of a cigarette filter. The placement of the two-part capsule may be such that there is filter material at both ends of the hollow tube as shown in FIGS. 1, 3 and 6*a* or the hollow tube containing the capsule may by placed at the mouth end of the filter as shown in FIG. 3. Additionally, the orientation of the two-part capsule may be such that the portions of the capsule where force is applied (A and B in FIG. 2 and D and E in FIG. 4*c*) are located within the axial circumference of the filter, while the direction of the additive release is oriented toward the filter portion on the tobacco rod side of the filter. It is noted that the orientation in FIGS. 1, 3 and 6*a* allow for access to applying force to the portions of the capsule designed to release additives upon the application of force.

In order to provide one or more microcapsules and/or macrocapsules in a filter for a cigarette, the microcapsules can be the same or different sizes. For example, microcapsules can be made with rounded shapes with diameters from 0.3 to 1.0 mm, but are preferably provided with diameters of about 0.3 to 0.4 mm. Preferably, the microcapsules are provided in the form of round, singular part seamless capsules with diameters of about 0.3 to about 0.4 mm. Macrocapsules, on the other hand can be rounded shapes, such as round, seamless singular part with diameters of 1.0 to 6.0 mm, but are preferably 3.0 to 4.0 mm. Round microcapsules and macrocapsules with these size ranges allows for the effect on the resistance to draw by the microcapsules and/or macrocapsules to be minimal and can be compensated for by cigarette design, such as reduced packing tightness of tobacco in the tobacco rod or the filter components in the filter.

It is noted that with microcapsules with a diameter of about 0.35 mm packed in a hollow tube with a diameter of about 8 mm, the hollow tube can achieve about 90% fill without a substantial change in the resistance to draw. It is also noted that microcapsules smaller than 0.3 mm diameter capsules may be used, however, if these smaller microcapsules are used, they are preferably dispersed in filter tow material in the filter, rather than in a cavity, as the smaller size may lead to tighter packing and may lead to a substantial increase in the resistance to draw if packed in a hollow tube portion of a filter.

As illustrated in FIG. 7*a*, microcapsules 800 (or single macrocapsule in FIG. 7*b*) can be provided through a portion of the depth, width and length of filter 40. The microcapsules 800, similar to the placement for the two-part capsule, can then be placed in a hollow tube 70 as shown in FIG. 7*a*, which can be by way of example, a hollow acetate tube having an external diameter of a cigarette filter.

Or, as illustrated in FIG. 7*b*, the macrocapsule 810 may be located in the filter 40 downstream from filter material 900, wherein the filter material 900 includes sorbents within ruffles or pleats of the filter material 900.

Figure 8:
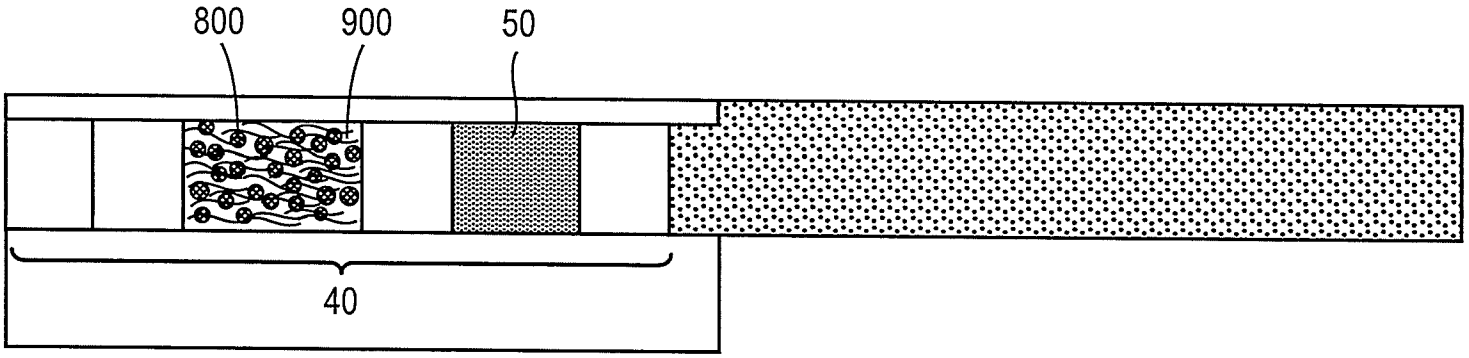
FIG. 8 is a cross-sectional view of a cigarette constructed in accordance with an embodiment including microcapsules in a filter material of a cigarette.

As yet another alternative, as illustrated in FIG. 8, microcapsules 800 may also be within the filter material 900, wherein the microcapsules are downstream from the sorbent region 50.

It is noted that the sorbent can also be incorporated into tow material for the filter. In an exemplary embodiment, activated carbon can be included within folds of a filter's tow material or within the bulk of the tow material, wherein the tow material forms a filter component of a cigarette, and wherein the microcapsules can be included in the hollow acetate tube filter component of the cigarette.

Figure 9:
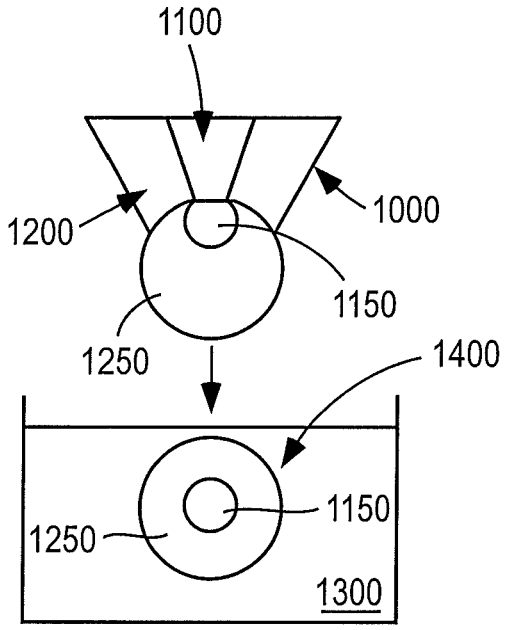
FIG. 9 is an illustration of a preferred method of manufacturing microcapsules.

Another preferred embodiment includes, as illustrated in FIG. 9, a method of forming a flavor capsule, such as microcapsules. As illustrated in FIG. 9, a concentric nozzle 1000 can be used to co-extrude microcapsules having a flavor core 1150 and shell 1250, the core being formed by a center passage 1100 of the concentric nozzle 1000 and the shell 1250 being formed by an outer passage 1200 of the concentric nozzle 1000. As also illustrated in FIG. 9, the capsule 1400 formed at the end of the concentric nozzle 1000 can be dropped into a solution 1300, where gelation can occur. By co-extruding a liquid center flavor core 1150 and a shell wall outer layer 1250, a capsule can be formed with a liquid center and a gelled shell wall thus providing a structural containment for a liquid additive. Alternatively, single extrusion may also be used to produce capsules.

Preferably, the flavor capsules 1400 may be made containing flavor cores 1150, which may be hydrophobic such as mint oil, menthol or other additives as mentioned above, and outer layers, such as shell walls 1250 composed of natural or natural and modified polysaccharides, but may also be a polymer or other shell wall materials. Preferred polysaccharides include pectin, alginate, carageenan, gums and agar. Preferred polymers include proteins like gelatin, modified cellulosics or synthetic polymers such as derivatives of polyacrylates.

Single extrusion to form capsules may also be possible. For example, a hydrophobic flavor can be dispersed within a solution of hydrophilic polysaccharide and the dispersion can be extruded through a single nozzle into a water-based cation solution suitable for cross-linking of the polysaccharide. By allowing separation of the hydrophobic flavor from the hydrophilic components of the system (the polysaccharide and the cation), a distinct hydrophobic core can be formed in a capsule.

For example, a single extrusion to form capsules can be accomplished by mixing a mixture of 1.1 g of a menthol/mint flavor formulation in a vial containing 5 ml LM20 (amidated low methoxy pectin with 20% methoxy content) pectin solution of 5% by weight in water. The vial can then be vigorously shaken to produce a dispersion of the flavor in the pectin solution. The dispersion can then be extruded through a syringe needle drop-wise into a calcium chloride solution under constant agitation. As a result, capsules of about 1-2 mm in size can be formed instantly as the drops impact the solution to crosslink the pectin by the calcium cations. The capsules can then be harvested and air dried. By using a Scanning Electron Microscopy (SEM) to investigate cross sections of capsules formed from the above exemplary methodology, it can be seen that the capsules can be formed with distinct core and shell geometries and with a non-uniform dispersion of the menthol/mint flavor formulation. Similarly, another mixture can also be formed containing 2.2 g of glycerol, 0.3 g of the menthol/mint flavor formulation and 1.5 g of the 5% LM20 pectin solution. Capsules from this mixture can similarly be formed by precipitation in calcium chloride solution and can result in a core-shell type geometry similar to the other capsules.

The thickness of the outer layer 1250 may be controlled through nozzle design, where the ratio and size of flavor core 1150 and the outer layer 1250 can be specifically chosen. Alternatively, the thickness of the outer layer 1250 may also be controlled through specific selection of an outer layer material and the solution used to gel the outer layer material, where the outer layer material and the solution may react quickly or slowly and therefore form thicker or thinner shell wall outer layers 1250 depending upon the speed of their reaction with the solution.

The flavor core 1150, as mentioned above, is preferably a hydrophobic flavor, but may also be a hydrophilic flavor. If a hydrophilic flavor is desired, however, the outer layer material properties are preferably different from those used with hydrophobic flavors. Additionally, the flavor core 1150 can also be a dispersion of hydrophilic and hydrophobic components, where preferably the hydrophilic component contains cations which can affect an outer region of the outer layer. The thickness may also be controlled through over-coating the primary capsule by additional ionic gelation encapsulation or other means.

Additionally, additives may be used to control the toughness, thermal stability, capsule functionality, etc. For example, cross-linking additives and humectants can be used to control the toughness of the shell wall outer layers 1250, while surfactants may be used to control hydrophilic/hydrophobic interfaces between the flavor core 1150 and the shell wall outer layer 1250 or between the shell wall outer layer 1250 and the solution 1300.

Example

A preferred synthesized capsule made using the apparatus illustrated in FIG. 9 is hereby described. In a particular formulation, similar to an annular jet method, a liquid wall material 1250 of a solution low methoxy (LM) pectin is fed to an outer portion 1200 of a concentric nozzle 1000, and also a liquid core material of a flavor core of a menthol/mint flavor is fed to an inner portion 1100 of the concentric nozzle 1000. Next, the menthol/mint flavor of the flavor core 1150 is co-extruded with the liquid wall material 1250 and broken into droplets, wherein the co-extruded droplets 1400 have predetermined sizes based on the extrusion rates of the inner and outer portions of concentric nozzle. The co-extruded droplets 1400 are then dropped into an ionic solution 1300 (e.g., a calcium ionic solution), wherein due to the reaction between the LM pectin and the ionic solution, ionic gelation of the LM pectin occurs, which hardens the LM pectin thus forming it into a shell wall.

It is noted that the LM pectin shell wall can then be dried at room temperature or at elevated temperatures with or without applying a vacuum to accelerate drying and to further solidify and stabilize the capsule, finally resulting in synthesized capsules of about 0.3 to 6.0 mm, preferably round capsules with a diameter of about 0.3 to about 0.4 mm are formed. It is noted that for these capsules, a capsule with a burst strength of about 0.5-0.8, 0.8-1.2, 1.2-1.6, 1.6-2.0 or 2.0-2.4 kilograms force (kgf) is preferred, but that the capsule burst strength can be altered based upon the amount of LM pectin provided in the droplet, as well as both the concentration level of the ionic solution and the amount of time that the droplet remains in the ionic solution for gellation. For example, the size, content ratio and rupture strength of the capsule can be controlled by controlling the extrusion rates of hydrophobic flavor and the hydrophilic shell wall independently from one another, wherein the extrusion rates of each of the menthol/mint flavor and the LM pectin determine how much of each is present per droplet and thus the size, content ratio and rupture strength can be controlled.

While the invention has been described in detail with reference to specific embodiments thereof, it will be apparent to one skilled in the art that various changes and modification may be made, and equivalents thereof employed, without departing from the scope of the claims.

The invention claimed is:

1. A filter for a cigarette comprising filter material, sorbent material, a hollow tube and a two-part capsule containing an additive material for modifying characteristics of tobacco smoke during smoking of the cigarette, the capsule comprising:

a first part having an open end defining a first chamber containing the additive material; and a second part having an open end defining a second chamber, wherein the second part fits around the first part and the open ends face each other in opposite directions, wherein the hollow tube contains the two-part capsule via friction fit within a lumen of the hollow tube, the first part and the second part of the capsule each include a plurality of annular indentations operable to connect and seal the first part and the second part to form a sealed pump such that the capsule is operable to release the additive material when a user applies pressure to the filter so as to cause mechanical separation of the first part from the second part of the capsule, the additive material is a liquid flavorant and the capsule includes solids therein in an amount sufficient to decrease a space available for the liquid flavorant therein, the capsule includes a porous compressive material or molecular sieve material therein to absorb the liquid flavorant, and the porous compressive material is a sponge.

2. The filter according to claim 1, wherein the two-part capsule further comprises a smaller capsule inside the first and second parts of the two-part capsule, wherein the smaller capsule includes a second additive material, wherein the additive material in the first part of the two-part capsule and the second additive material are different from one another.

3. The filter according to claim 1, wherein the capsule is located downstream from the sorbent material.

4. The filter according to claim 1, wherein the sorbent material comprises activated carbon.

5. The filter according to claim 1, wherein the solids comprise solid flavor compound particles.

6. The filter according to claim 1, further comprising a band seal at a junction of the first part and the second part of the two-part capsule.

7. The filter according to claim 1, wherein the solids are loaded with menthol.

8. The filter according to claim 1, wherein the solids comprise silica, alumina, flavor particles, and/or carbon.

9. The filter according to claim 1, wherein the capsule further includes a combination of menthol flavored microcapsules and tobacco flavored microcapsules therein.

10. The filter according to claim 1, wherein the liquid flavorant is adsorbed in pores of the solids.

11. The filter according to claim 1, wherein the capsule is oriented in the hollow tube such that a direction of additive material release during use is toward a tobacco rod side of the filter.

12. The filter according to claim 1, wherein the capsule includes a viscosity modifier to control a wicking rate of the liquid flavorant from the capsule.

13. The filter according to claim 12, wherein the viscosity modifier is a wax.

* * * * *